US011590401B2

(12) United States Patent
Teasdale

(10) Patent No.: US 11,590,401 B2
(45) Date of Patent: Feb. 28, 2023

(54) SPORTS EQUIPMENT DRYING RACK

(71) Applicant: Ryan Teasdale, Ferndale, MI (US)

(72) Inventor: Ryan Teasdale, Ferndale, MI (US)

( * ) Notice: Subject to any disclaimer, the term of this patent is extended or adjusted under 35 U.S.C. 154(b) by 0 days.

(21) Appl. No.: 16/154,857

(22) Filed: Oct. 9, 2018

(65) Prior Publication Data

US 2019/0105550 A1 Apr. 11, 2019

Related U.S. Application Data

(60) Provisional application No. 62/569,820, filed on Oct. 9, 2017.

(51) Int. Cl.

| | |
|---|---|
| ***A63B 71/00*** | (2006.01) |
| ***A47B 47/04*** | (2006.01) |
| ***A42B 3/00*** | (2006.01) |
| *A47B 81/00* | (2006.01) |
| *A47B 47/00* | (2006.01) |
| *A47F 5/00* | (2006.01) |

(52) U.S. Cl.

CPC ..... *A63B 71/0036* (2013.01); *A42B 3/006* (2013.01); *A47B 47/04* (2013.01); *A47B 47/00* (2013.01); *A47B 81/00* (2013.01); *A47B 2230/0085* (2013.01); *A47F 5/00* (2013.01); *A63B 2209/00* (2013.01)

(58) Field of Classification Search

CPC ... A63B 71/0036; A63B 71/12; A63B 71/143; A63B 2209/00; A47B 81/00; A47B 47/00; A47B 47/04; A47B 47/0025; A47B 47/0041; A47B 47/0058; A47B 47/0066; A47B 47/0075; A47B 47/0091; A47B 47/025; A47B 47/03; A47B 47/042; A47B 47/047; A47B 2230/0085; A42B 3/006; A47F 5/00

USPC .... 211/85.7, 85.11, 70.5, 70.8, 85.23, 132.1, 211/133.4, 205, 133.1, 196, 195, 85.3, 211/182, 189

See application file for complete search history.

(56) References Cited

U.S. PATENT DOCUMENTS

| | | | | | |
|---|---|---|---|---|---|
| 869,608 | A * | 10/1907 | Wilcox | A47F 7/30 | 211/27 |
| 894,561 | A * | 7/1908 | Wood | A47F 7/10 | 211/170 |
| 1,480,939 | A * | 1/1924 | Hand | G11B 33/0444 | 211/189 |
| 1,554,137 | A * | 9/1925 | Slifkin | A47B 57/52 | 108/6 |
| 1,897,905 | A * | 2/1933 | Johnson | A47G 7/041 | 211/85.23 |
| 2,401,148 | A * | 5/1946 | Gaffney | A47K 10/04 | 211/124 |
| 2,945,732 | A * | 7/1960 | Edmondson, Jr. | A47B 88/90 | 312/140.3 |

(Continued)

FOREIGN PATENT DOCUMENTS

FR 2856902 A1 * 1/2005 ..... A47B 3/06

*Primary Examiner* — Devin K Barnett

(74) *Attorney, Agent, or Firm* — Carlson, Gaskey & Olds, P.C.

(57) ABSTRACT

This disclosure relates to a drying rack for wet equipment constructed to support wet equipment having absorbent and non-absorbent sides. The drying rack supports the equipment such that absorbent sides of the wet equipment are generally oriented in a single windward direction relative to an external airflow source.

14 Claims, 4 Drawing Sheets

(56) References Cited

U.S. PATENT DOCUMENTS 3,004,673 A * 10/1961 Emery ..... A47F 7/0028 211/70.8
3,204,867 A * 9/1965 Wahlbom ..... A47B 73/008 232/43.3
3,338,422 A * 8/1967 Hickok ..... A63C 11/028 211/204
3,394,790 A * 7/1968 Braun ..... A63C 11/007 194/256
3,464,565 A * 9/1969 Nevai ..... A47B 65/00 211/186
3,527,354 A * 9/1970 Sokolow ..... A47F 7/0035 182/150
3,858,727 A * 1/1975 Levko ..... G09F 7/06 211/89.01
3,887,288 A * 6/1975 Glaser ..... A47B 3/00 211/189
4,691,832 A * 9/1987 Steiger ..... A47F 5/13 211/181.1
4,696,122 A * 9/1987 Van Der Zyl ..... A01K 97/08 211/70.8
4,715,503 A * 12/1987 Johnson ..... A47B 47/04 211/189
4,809,146 A * 2/1989 Johnson ..... A47B 47/04 211/189
D301,094 S * 5/1989 Muxlow ..... D6/681.1
4,825,620 A * 5/1989 Johnson ..... A47B 47/04 211/189
4,991,726 A * 2/1991 Johnson ..... A47B 47/04 211/189
5,129,525 A * 7/1992 Maynard, Jr. ..... A47B 19/04 211/133.1
5,143,230 A * 9/1992 LaCorte ..... B65H 35/002 211/85.28
5,185,982 A * 2/1993 Hostetler ..... F16B 7/044 211/189
5,211,295 A * 5/1993 Dunn ..... A47F 5/02 211/163
5,285,612 A * 2/1994 Johnson ..... A47B 47/04 403/346
5,307,944 A * 5/1994 Reedy ..... A47B 81/005 211/106
D349,000 S * 7/1994 Rogers ..... D6/566
D352,195 S * 11/1994 Rogers ..... D6/705.6
D354,654 S * 1/1995 Mallen ..... D6/552
5,377,849 A * 1/1995 Martin ..... A47F 8/02 211/85.7
5,412,928 A * 5/1995 Reithel ..... A47L 23/205 34/104
5,472,098 A * 12/1995 Ho ..... A47B 23/042 211/189
5,487,475 A * 1/1996 Knee ..... A47B 81/005 211/70.8
5,490,599 A * 2/1996 Tohidi ..... H04R 1/406 211/171
5,626,379 A * 5/1997 Scott ..... A47B 81/005 211/195
5,657,883 A * 8/1997 Badia ..... A01K 97/10 211/60.1
D387,231 S * 12/1997 Turcotte ..... D6/552
D398,469 S * 9/1998 Leong ..... D6/552
D401,084 S * 11/1998 Martin ..... D6/675.3
5,832,689 A * 11/1998 Curll ..... A47B 47/0041 52/656.9
5,862,924 A * 1/1999 Dumont ..... A47F 5/04 211/118
5,881,892 A * 3/1999 Loo ..... A47F 5/0025 211/126.13
5,947,306 A * 9/1999 Chang ..... A47G 7/044 211/133.4
6,059,630 A * 5/2000 Paxton ..... A63H 33/044 446/106
6,073,783 A * 6/2000 Allman ..... D06F 59/02 211/85.3
6,132,129 A * 10/2000 Frazier ..... A47B 13/04 403/217
6,164,465 A * 12/2000 Schroeder ..... A47B 43/00 211/85.7
6,216,887 B1 * 4/2001 Soo ..... A47G 25/0671 211/189
6,220,459 B1 * 4/2001 Runyon ..... A47F 7/00 211/195
6,378,707 B1 * 4/2002 Taggert ..... A47B 65/00 211/186
6,457,619 B1 * 10/2002 Werner ..... B60P 3/40 211/70.1
D475,554 S * 6/2003 Ming-Shiue ..... D6/675
6,615,999 B1 * 9/2003 Culp ..... A47B 47/042 211/184
6,691,877 B1 * 2/2004 Ohm ..... A47F 7/0028 211/85.7
6,692,332 B2 * 2/2004 Jheow ..... A63H 3/16 446/383
7,014,280 B2 * 3/2006 Borgen ..... A47B 46/005 108/109
7,017,760 B2 * 3/2006 Zuclich ..... A47B 81/06 211/187
7,025,215 B2 * 4/2006 Bain ..... A47G 25/0664 211/85.31
7,182,000 B1 * 2/2007 Dicksen ..... B25B 13/481 81/177.2
D599,601 S * 9/2009 Mallen ..... D32/58
8,042,229 B2 * 10/2011 Wang ..... A47B 57/26 16/253
8,105,127 B2 * 1/2012 Heston ..... A63H 33/084 446/106
8,302,363 B1 * 11/2012 Johnson ..... E04H 6/025 52/655.1
D707,209 S * 6/2014 Ranaletta ..... D14/239
8,966,781 B1 * 3/2015 McKernan ..... A61L 2/07 211/189
D760,851 S * 7/2016 Cummings ..... D21/578
9,668,573 B2 * 6/2017 Salani ..... A47B 73/006
10,004,330 B1 * 6/2018 Kasza ..... F16B 9/026
2001/0037987 A1 * 11/2001 Culp ..... A47B 47/042 211/186
2002/0178979 A1 * 12/2002 Tidemann ..... A47B 47/042 108/186
2003/0034320 A1 * 2/2003 Noh ..... A47F 5/10 211/189
2003/0066814 A1 * 4/2003 Wang ..... A47B 47/0075 211/189
2003/0132180 A1 * 7/2003 Chen ..... A47F 7/00 211/85.7
2003/0222038 A1 * 12/2003 Collier ..... A47G 25/0671 211/85.7
2004/0211738 A1 * 10/2004 Priefert ..... B68C 1/002 211/85.11
2006/0054576 A1 * 3/2006 Durham ..... A47L 23/205 211/85.7
2006/0186073 A1 * 8/2006 Roe ..... D06F 59/02 211/196
2007/0102383 A1 * 5/2007 Evans ..... A47G 25/0671 211/85.7
2007/0125279 A1 * 6/2007 Fryoux ..... A47B 13/08 108/26
2007/0175848 A1 * 8/2007 Mallen ..... A47G 25/0671 211/196
2008/0000865 A1 * 1/2008 Babcock ..... A47F 5/04 211/196
2008/0169253 A1 * 7/2008 Vitale ..... A47B 57/06 211/85.7
2008/0252189 A1 * 10/2008 Regan ..... A47B 81/00 312/249.8
2009/0071922 A1 * 3/2009 Barra ..... F16M 11/28 211/85.3
2009/0309464 A1 * 12/2009 Schwartz ..... A47B 47/0033 312/111

(56) References Cited

U.S. PATENT DOCUMENTS

2011/0036794 A1* 2/2011 Schott ..... A47G 25/0671 211/85.3
2012/0024808 A1* 2/2012 Jackson ..... D06F 57/04 211/85.7
2012/0074082 A1* 3/2012 Hornsby ..... A47G 25/0685 211/85.3
2012/0137534 A1* 6/2012 Barnard ..... D06F 57/02 34/72
2012/0181243 A1* 7/2012 Longanecker ..... A63B 69/0002 211/85.7
2012/0279936 A1* 11/2012 Rimmer ..... D06F 57/04 211/85.7
2013/0062828 A1* 3/2013 Cube-Sherman ..... A63F 9/0876 273/153 S
2013/0082016 A1* 4/2013 Arrow ..... A47G 25/0671 211/85.1
2014/0014604 A1* 1/2014 de Moraes Correia ..... A63B 71/0622 211/85.7
2014/0129485 A1* 5/2014 Fisher ..... A47F 7/0035 705/500
2014/0238946 A1* 8/2014 Nally ..... A63B 47/007 211/85.7
2014/0332655 A1* 11/2014 Colbert ..... A01K 97/10 248/512
2014/0373357 A1* 12/2014 Elliott ..... B23P 11/00 29/897
2015/0068121 A1* 3/2015 Probst ..... A01G 31/06 47/59 R
2015/0068994 A1* 3/2015 Kerman ..... B62H 3/00 211/85.7
2015/0083678 A1* 3/2015 Baughman ..... G09F 15/0056 211/85.3
2015/0083680 A1* 3/2015 Beckerich ..... A63D 15/10 211/85.7
2015/0113827 A1* 4/2015 Goulet ..... F26B 9/06 34/443
2015/0157125 A1* 6/2015 Vezirov ..... A47B 47/0075 211/153
2015/0259045 A1* 9/2015 Wilhelm ..... F16B 2/08 211/85.7
2015/0306488 A1* 10/2015 Gouldthorpe ..... A63C 17/017 312/330.1
2016/0121181 A1* 5/2016 Pollard ..... A63B 57/207 211/85.7
2016/0167748 A1* 6/2016 Dias ..... B63B 35/7946 211/85.7
2017/0127825 A1* 5/2017 Melnick ..... F16B 1/00
2019/0070480 A1* 3/2019 Armstrong ..... A63B 71/0036

* cited by examiner

SPORTS EQUIPMENT DRYING RACK

CROSS-REFERENCE TO RELATED APPLICATIONS

This application claims priority to U.S. Provisional Application No. 62/569,820, which was filed on Oct. 9, 2017 and is incorporated herein by reference.

BACKGROUND

This disclosure relates to a sports equipment storage and drying rack, particularly for hockey equipment.

Many sports, including hockey, have associated protective equipment like pads and a helmet. Many articles of protective equipment have a hard plastic exterior with a padded foam or fabric interior. Protective equipment commonly gets wet during use because the padded interiors accumulate the wearer's sweat. Wet equipment is frequently dried evaporatively, which can be facilitated by air circulation near wet portions of the equipment.

Racks for drying and organizing protective equipment exist in multiple varieties. Drying racks are commonly designed to "wear" equipment similarly to a person, such that the padded sides are directed inward, contacting the rack. Such a rack may be placed near an external fan or other source of airflow. Other racks have internal passages for circulating a drying airflow from an integral source against the padded interiors of the equipment.

SUMMARY

This disclosure relates to a drying rack for wet equipment constructed to support wet equipment having absorbent and non-absorbent sides. The drying rack supports the equipment such that absorbent sides of the wet equipment are generally oriented in a single windward direction relative to an external airflow source.

These and other features may be best understood from the following drawings and specification.

BRIEF DESCRIPTION OF THE DRAWINGS

The drawings can be briefly described as follows.

DETAILED DESCRIPTION

Figure 1:
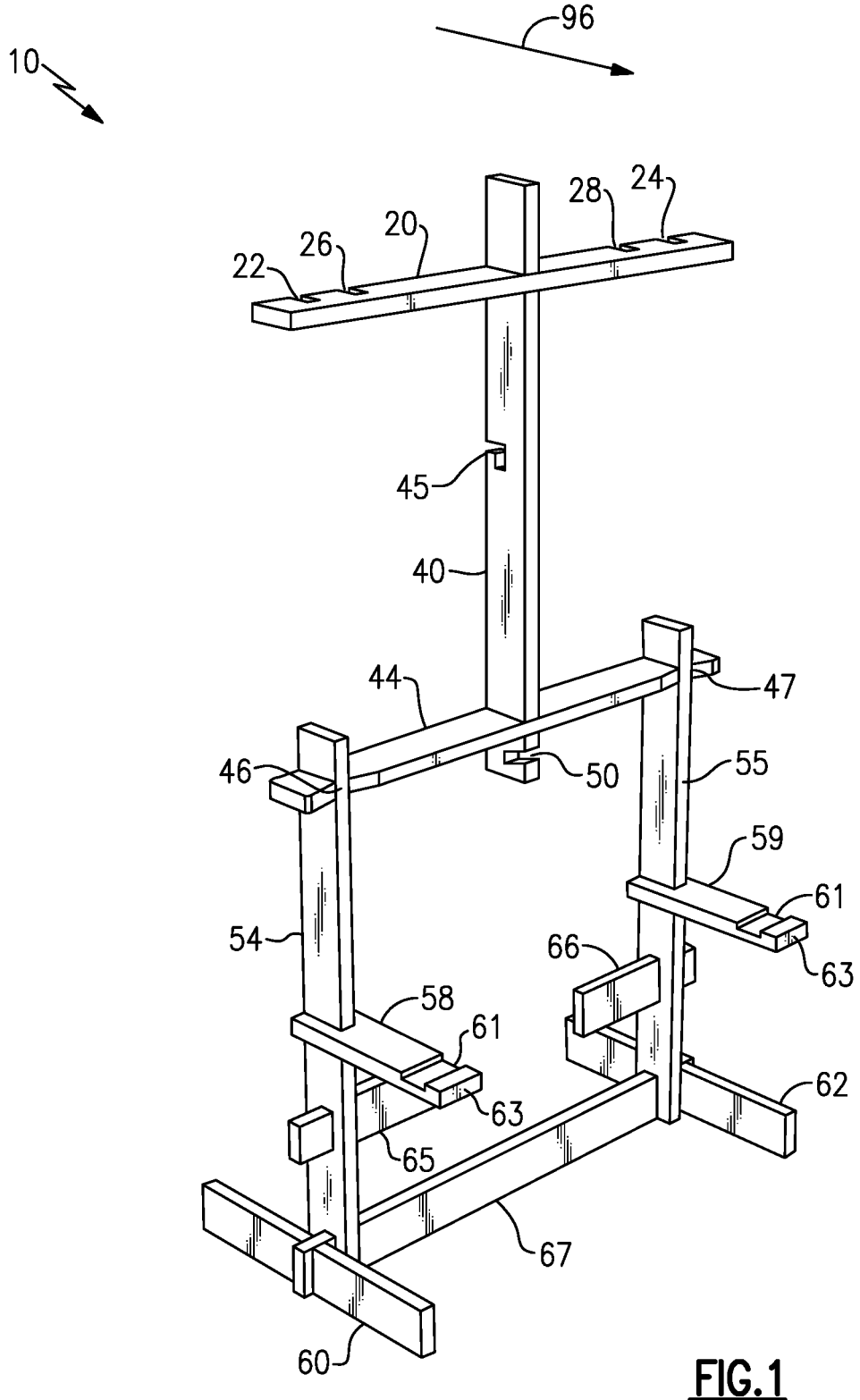
FIG. 1 shows a drying rack.

FIG. 1 illustrates a rack 10 for drying sports equipment according to a first embodiment. The rack 10 has an upper arm 20 extending in a substantially horizontal direction, supported by an upper beam 40 extending in a direction substantially perpendicular to the upper arm 20. Hooks 22, 24, 26, 28 are cut into the upper arm 20.

A back hook 45 is cut into to a back side of the upper beam 40, and a front hook 50 is cut into a front or windward side of the upper beam 40. A lower arm 44 extends in a horizontal or substantially horizontal direction, supports the upper beam 40, and is supported by a first lower beam 54 and a second lower beam 55. The lower arm 44 may have recesses 46, 47 on a windward side, each approximately aligned with one of the lower beams 54, 55.

The first lower beam 54 and second lower beam 55 both extend in a direction perpendicular to the lower arm 44. A first shelf 58 is attached to the first lower beam 54, and a second shelf 59 is attached to the second lower beam 55. Both shelves 58, 59 extend in a windward direction 96 that is perpendicular to the first and second lower beams 54, 55. Each of the shelves 58, 59 also includes a notch 61 near a respective windward end 63.

A first stop 65 and second stop 66 are slotted into the first lower beam 54 and second lower beam 55 respectively. The first stop 65 and second stop 66 extend toward each other and perpendicularly to the first and second lower beams 54, 55.

The first and second lower beams 54, 55 are both slotted into a foundation 67 extending perpendicularly to the first and second lower beams 54, 55. A pair of feet 60, 62 are slotted into the foundation 67 near respective opposite ends of the foundation 67. The feet 60, 62 extend perpendicularly to the foundation 67, thereby providing a stable base for the rack 10.

Several materials are suitable for constructing the rack 10, such as wood, plywood, or plastic. Moisture resistant materials are conducive to a durable and long lasting rack 10. As such, wood or plywood used to build the rack 10 could be treated or coated with a seal or moisture repellant. In another example, the rack 10 could be constructed from PVC or other plastic polymers.

Figure 2:
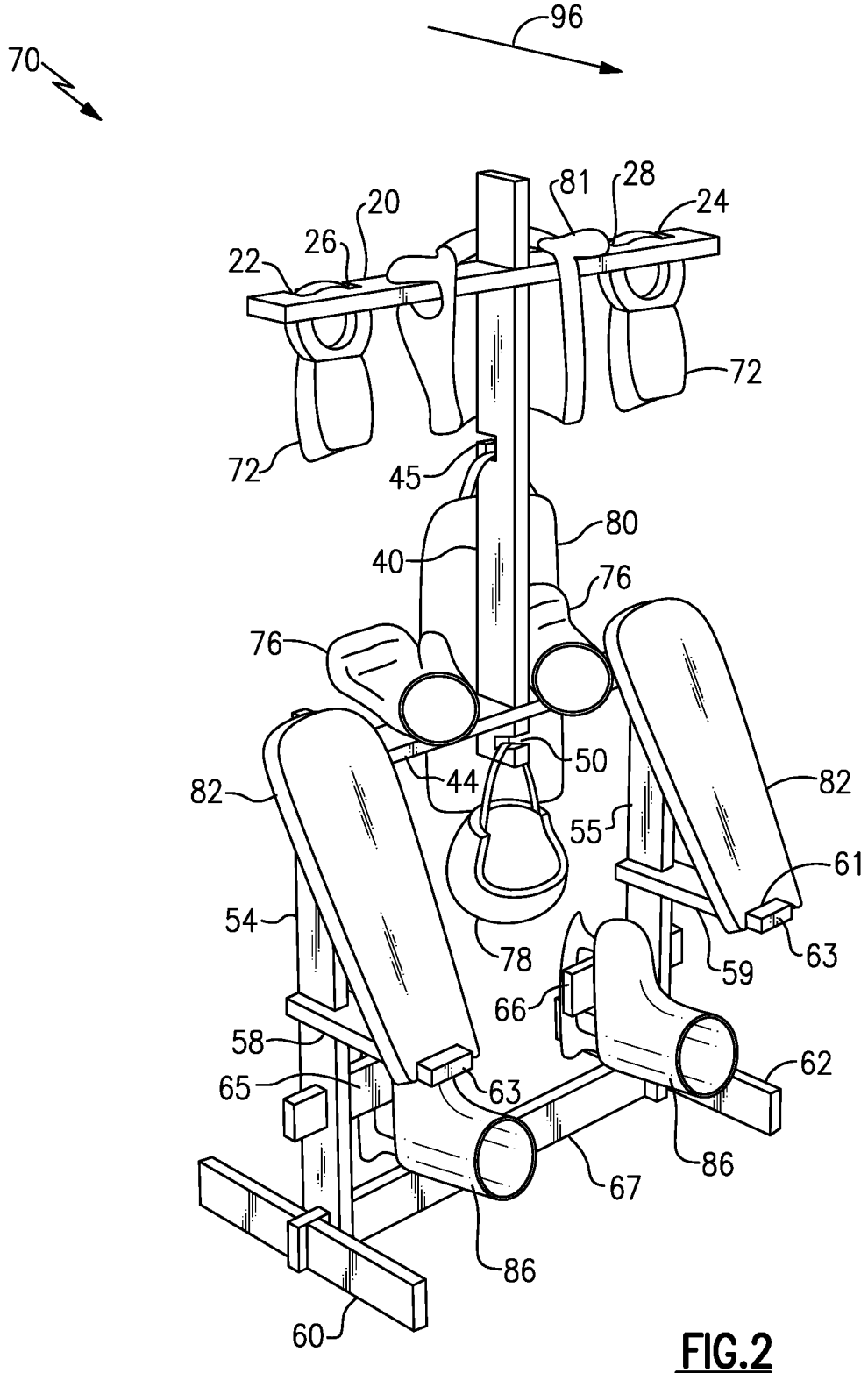
FIG. 2 shows the drying rack loaded with sports equipment.

FIG. 2 shows a loaded rack 70, comprising the rack 10 loaded with sports equipment. As with regard to the first embodiment, it should be understood that a loaded rack 70 may include different equipment and may have equipment arranged differently than exactly as depicted without departing from the scope of the disclosure. According to one example, the sports equipment can include a complete set of hockey pads supported to keep the equipment off of a floor.

Shoulder pads 81 hang from the upper arm 20. Elbow pads 72 hang from hooks 22, 24, 26, and 28. Gloves 76 rest on the lower arm 44. The lower arm 44 may have a slight forward or windward slope such that the gloves 76 when arranged as depicted, have fingertips raised above wrists to facilitate drainage by gravity. Pants 80 may hang from the back hook 45. A helmet 78 hangs from the front hook 50. Shin guards 82 sit on the first and second shelves 58, 59. The shin guards 82 may also rest in the recesses 46, 47 and notches 61. Additional garments such as shorts or a towel may hang from ends or corners of the upper arm 20 or any other available protrusion on the rack 10. Skates 86 may rest on the foundation 67 and hang from the stops 65, 66.

Most or all of the elbow pads 72, gloves 76, helmet 78, shoulder pads 81, shin guards 82, and skates 86, are arranged on rack 70 such that their interiors are oriented generally toward a front of the rack 70 in a windward direction 96.

Figure 3:
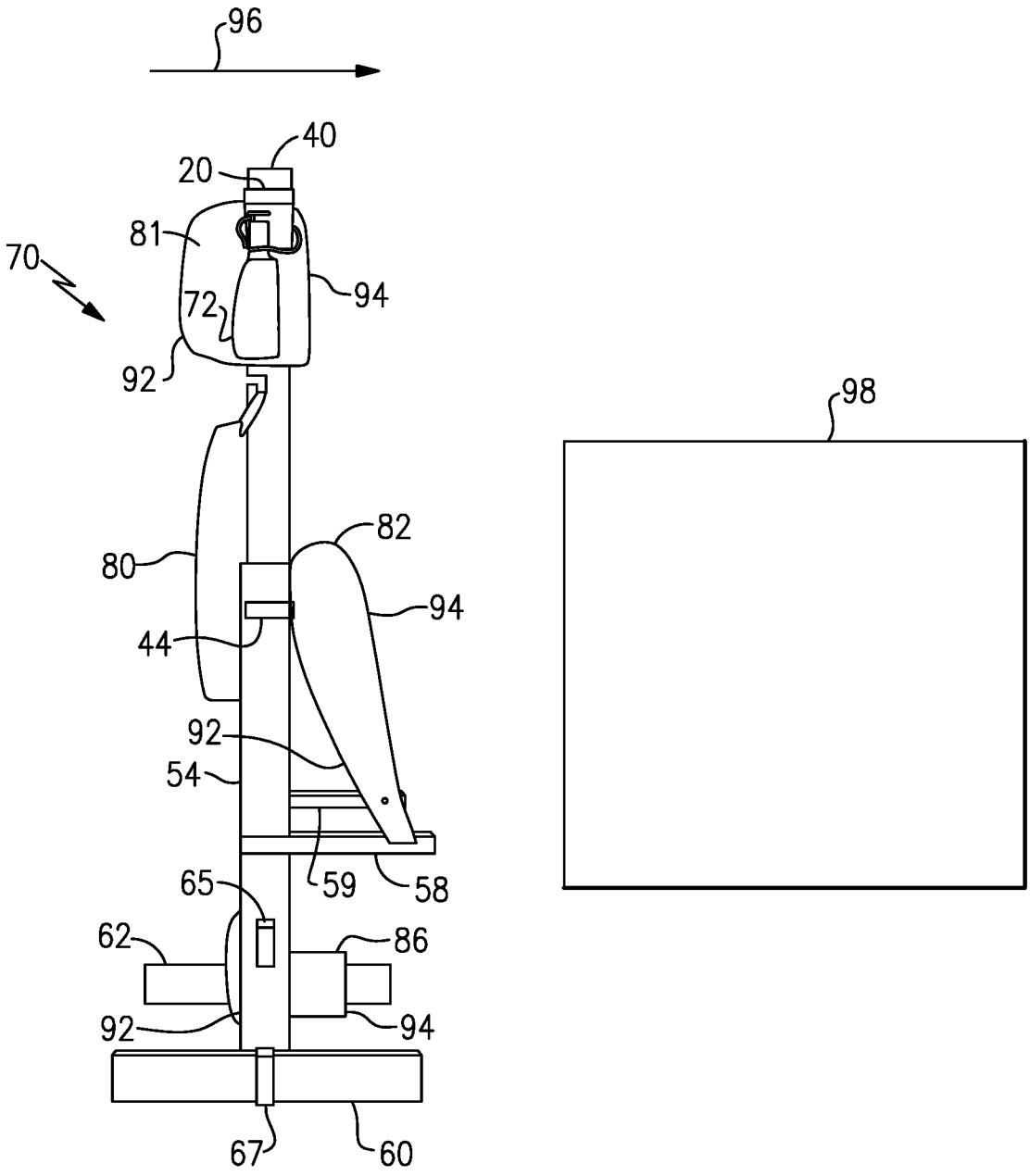
FIG. 3 schematically represents a drying rack loaded with sports equipment and arranged near an external air source.

FIG. 3 schematically represents the loaded rack 70 placed near an external airflow source 98, such as a fan. The equipment has hard plastic sides 92 and absorbent padded sides 94. As illustrated, the padded sides 94 of the equipment loaded on the rack 70 generally face in the windward direction 96 facing the airflow source 98. The loaded rack 70 is oriented such that its front side faces generally in a windward direction 96, toward the external airflow source 98. The construction of the rack 70 is such that even the absorbent material in the shoulder pads 81 hanging from the upper arm 20 are exposed to airflow from the airflow source 98. In this way, absorbent parts of the equipment on the loaded rack 70 is presented in the windward direction 96, which facilitates air circulation near the absorbent parts of the equipment. The air circulation near the absorbent parts of the material facilitates evaporative drying of the equipment.

Figure 4:
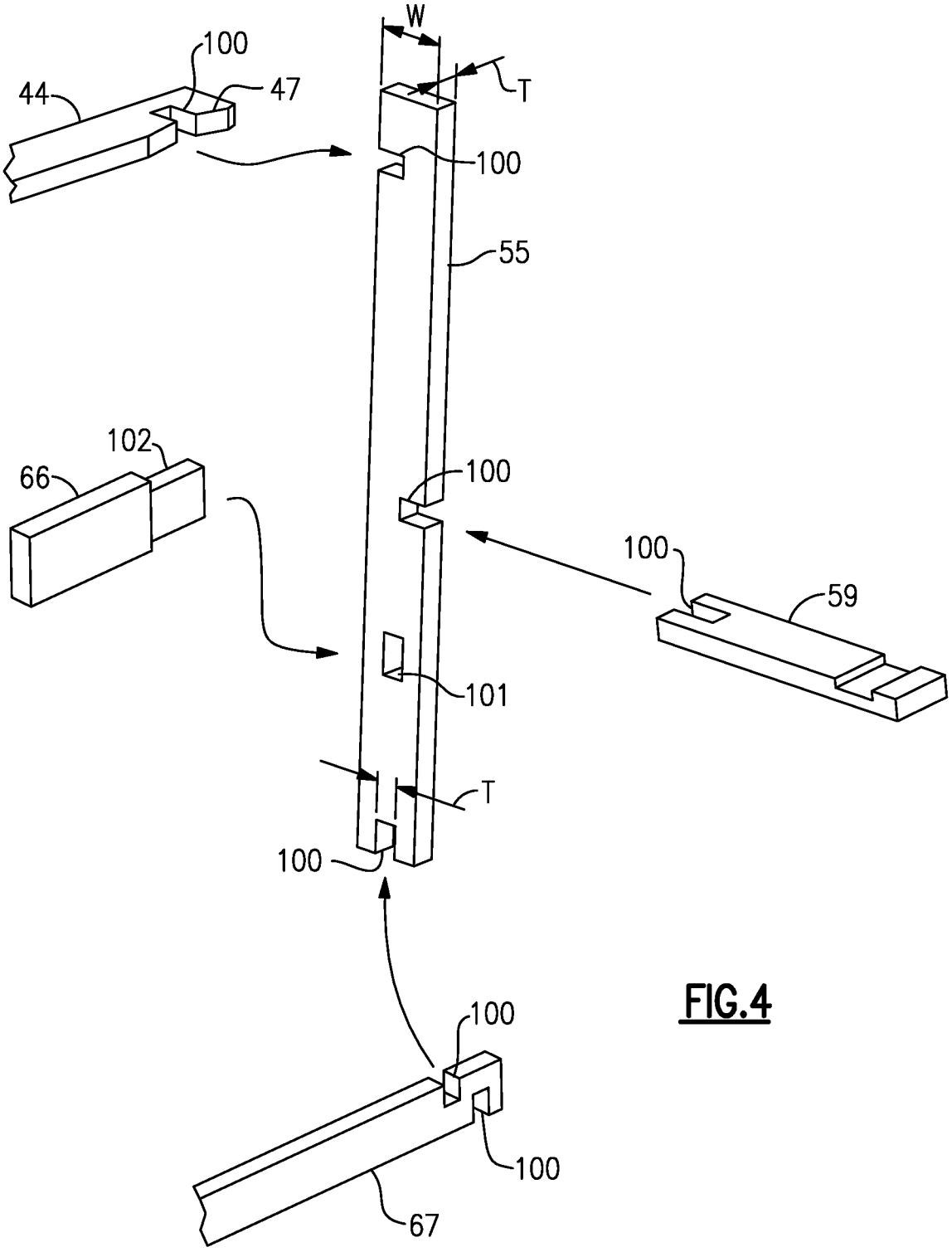
FIG. 4 is an exploded view of part of the drying rack.

The rack 10 according to the illustrated embodiment is constructed of several separable planks. For example, as illustrated in FIG. 4, each of the second lower beam 55, second shelf 59, second stop 66, lower arm 44, and foundation 67 is a separable plank having joining slots 100. Each of the separable planks according to the illustrated embodiment adheres to a certain maximum width W and thickness T to enable stacking for storage and transport. The lower beams 54, 55 have openings 101 for receiving a plank 102 extending from a respective one of the first stop 65 and second stop 66. Only the second lower beam 55, second shelf 59, second stop 66, lower arm 44, and foundation 67 are illustrated with slots 100 in FIG. 4, but the upper arm 20, upper beam 40, first lower beam 54, first shelf 58, and feet 60, 62 are similarly separable and have similar slots 100.

The slots 100 each match the thickness T to provide a close fit, which results in a sturdy construction that can be disassembled when necessary. Likewise, the openings 101 match dimensions of the planks 102 to provide a close fit. The elements slot together as suggested in FIG. 4 to provide the rack 10 in an assembled state as illustrated in FIG. 1. The close fit between each element makes the assembled rack 10 or 70 able stand freely and support heavy equipment without any fasteners. The close fit may further prevent any part of the rack 10 from rotating significantly or at all relative to another part of the rack 10 when in the assembled state.

Although examples above have the specific components shown in the illustrations, embodiments of this disclosure are not limited to those particular combinations. It is possible to use some of the components or features from one of the examples in combination with features or components from another one of the examples.

Further, all illustrated proportions and relative directions are merely exemplary, and variations to each are contemplated. For example, any two elements illustrated and described above as perpendicular to one another may in practice be only approximately or generally perpendicular to one another.

One of ordinary skill in this art would understand that the above-described embodiments are exemplary and non-limiting. That is, modifications of this disclosure would come within the scope of the claims. For example, equipment may differ from the particular articles described above. Also, while the description above generally relates to hockey equipment, equipment for other sports is expressly contemplated. Accordingly, the following claims should be studied to determine their true scope and content.

What is claimed is:

1. A drying rack for wet equipment, comprising:

a plurality of planks that interlock and are separable via a press fit, the rack having a front side and a back side, the front side faces a single windward direction when in use, the rack configured to support a complete set of personal hockey equipment in an orientation that exposes absorbent material in each article of the hockey equipment in the windward direction, the planks including:

a foundation beam extending horizontally;

a pair of feet that interlocks with the foundation beam and extends in the windward direction perpendicular to the foundation beam;

a first lower beam and a second lower beam that interlocks with and extends vertically upward from the foundation beam;

a lower arm that interlocks with the first and second lower beams, the lower arm extending in a horizontal direction parallel to the foundation beam and positioned vertically above the foundation beam;

an upper beam that interlocks with and extends vertically upward from the lower arm, the upper beam positioned between the first and second lower beams;

an upper arm that interlocks with the upper beam and extends in a horizontal direction parallel to the lower arm and positioned vertically above the lower arm; and a first stop and a second stop extending horizontally towards each other from opposed sides of the rack, the first stop is cantilevered from the first lower beam and the second lower beam is cantilevered from the second lower beam, wherein the first stop and the second stop are each configured to hold an article from the complete set of personal hockey equipment.

2. The drying rack of claim 1, wherein the rack is formed from a moisture resistant material.

3. The drying rack of claim 1, wherein the planks further include a first shelf and a second shelf that are cantilevered and extend from the rack in a direction parallel to the windward direction.

4. The drying rack of claim 3, wherein the first shelf interlocks with and is cantilevered from the first lower beam and the second shelf interlocks with and is cantilevered from the second lower beam.

5. The drying rack of claim 4, wherein the first shelf interlocks with the first lower beam vertically above the first stop and the second shelf interlocks with the second lower beam vertically above the second stop.

6. The drying rack of claim 5, wherein the first and second shelves are configured, in use, to support a pair of shin guards of the complete set of personal hockey equipment in an orientation that exposes absorbent material of the pair of shin guards in the windward direction.

7. The drying rack of claim 1, wherein the first and second stops are configured, in use, to support a pair of skates of the complete set of personal hockey equipment such that the pair of skates hang from the first and second stops in an orientation that exposes absorbent material of the pair of skates in the windward direction.

8. The drying rack of claim 1, wherein the planks each have an equal thickness and at least two of the planks each include a slot, the slot having thickness equal to the thickness of the planks, and the slots of the at least two of the planks interlocking.

9. The drying rack of claim 8, wherein at least one of the planks includes an opening hole and another of the planks extends through the opening hole.

10. The drying rack of claim 1, wherein the rack is configured to support each article of the complete set of personal hockey equipment such that, in use, an absorbent side of each article faces into airflow produced by a wind source in the windward direction relative to the rack.

11. The drying rack of claim 1, wherein an assembled state of the drying rack is able to stand freely and is configured to support the complete set of personal hockey equipment without fasteners.

12. The drying rack of claim 1, further comprising at least one hook configured for hanging at least one article of the complete set of personal hockey equipment.

13. The drying rack of claim 12, wherein the at least one hook is provided on the back side of the rack, and the rack provides space such that, when in use, the article hanging from the at least one hook is at least partially exposed in the windward direction.

14. The drying rack of claim 12, wherein the at least one hook comprises a slot in the upper arm.

* * * * *